US006994377B2

(12) United States Patent
Büttner

(10) Patent No.: US 6,994,377 B2
(45) Date of Patent: Feb. 7, 2006

(54) SHEET BINDING SYSTEM

(76) Inventor: Matthias Büttner, Saargemünder Strasse 156, D-66119 Saarbrücken (DE)

( * ) Notice: Subject to any disclaimer, the term of this patent is extended or adjusted under 35 U.S.C. 154(b) by 151 days.

(21) Appl. No.: 10/296,184

(22) PCT Filed: May 15, 2001

(86) PCT No.: PCT/EP01/05517

§ 371 (c)(1),
(2), (4) Date: Nov. 21, 2002

(87) PCT Pub. No.: WO01/89859

PCT Pub. Date: Nov. 29, 2001

(65) Prior Publication Data

US 2003/0122295 A1 Jul. 3, 2003

(30) Foreign Application Priority Data

May 22, 2000 (DE) ..... 200 08 946
Apr. 27, 2001 (DE) ..... 201 07 310

(51) Int. Cl.
*B42D 17/00* (2006.01)

(52) U.S. Cl. ..... 281/21.1; 281/15.1; 281/45; 281/48; 281/49; 281/50; 281/46; 211/40; 211/47; 211/169; 402/26; 402/38; 402/73; 402/74; 402/75; 402/80 R

(58) Field of Classification Search ..... 281/21.1, 281/45, 49, 50, 15.1, 46, 48; 402/75, 26, 402/38, 73, 74, 80 R; 211/40, 47, 169
See application file for complete search history.

(56) References Cited

U.S. PATENT DOCUMENTS

| | | | | | |
|---|---|---|---|---|---|
| 39,300 | A | * | 7/1863 | Mets | 281/15.1 |
| 243,772 | A | * | 7/1881 | Glover | 40/536 |
| 353,844 | A | * | 12/1886 | Staats | 16/442 |
| 780,904 | A | * | 1/1905 | McVitty | 281/50 |
| 1,609,589 | A | * | 12/1926 | Wahlgren | 281/50 |
| 4,426,007 | A | * | 1/1984 | Beleckis et al. | 211/40 |
| 4,445,710 | A | * | 5/1984 | Borel | 281/45 |
| 4,601,489 | A | * | 7/1986 | Stancato | 281/21.1 |
| 4,949,997 | A | | 8/1990 | Champagne | |
| 4,997,206 | A | * | 3/1991 | Hong | 281/15.1 |
| 5,056,823 | A | * | 10/1991 | Stancato | 281/49 |
| 5,104,147 | A | * | 4/1992 | King | 281/21.1 |
| 5,186,496 | A | * | 2/1993 | Seki | 281/46 |
| 5,636,869 | A | * | 6/1997 | Holmes | 281/45 |
| 5,725,251 | A | * | 3/1998 | Heggeland | 281/48 |
| 5,947,523 | A | * | 9/1999 | Liegard | 281/28 |

FOREIGN PATENT DOCUMENTS

| | | |
|---|---|---|
| DE | 3206695 | 9/1983 |
| DE | 26591 | 10/1983 |
| GB | 248591 | 3/1926 |

* cited by examiner

*Primary Examiner*—Derris Banks
*Assistant Examiner*—Mark Henderson
(74) *Attorney, Agent, or Firm*—Friedrich Kueffner

(57) ABSTRACT

The invention relates to a sheet-retaining system for securing sheets on a sheet carrier, in particular for securing paper sheets in a cover, having a retaining and connecting device for securing at least one sheet at the sheet edge and for connecting the at least one sheet to the sheet carrier indirectly via the retaining and connecting device. According to the invention, the retaining and connecting device has a retaining bar which is connected to the at least one sheet, may possibly be subdivided into separate sections and extends along the sheet edge which is directed towards the sheet carrier.

7 Claims, 4 Drawing Sheets

SHEET BINDING SYSTEM

Figure 1:
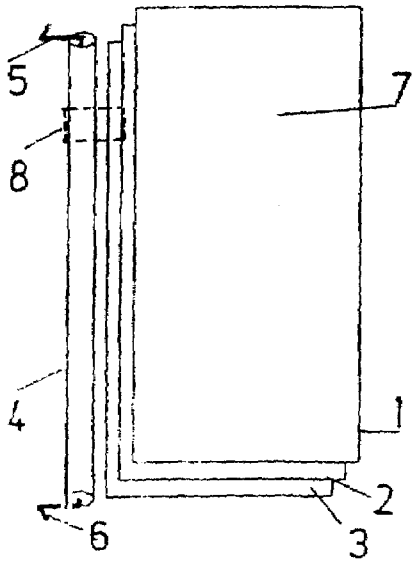

The invention relates to a retaining system for securing sheets in a cover, having a carrier rail which is arranged on the spine of the cover and extends continuously over the length of the sheet side edge directed towards the spine, and having a retaining and connecting device which is provided for securing at least one sheet at the abovementioned sheet side edge and has a retaining bar which extends along the sheet side edge and the carrier rail and via which the sheet can be connected indirectly to the carrier rail.

Such a sheet-retaining system which is known from use has binding ties as the retaining and connecting device, it being possible for a plurality of perforated sheets to be bound together with the aid of said binding ties. These binding ties are themselves perforated, with the result that the sheets bound together by the binding tie can be bound, for example, into a file as a sheet carrier with the aid of the binding tie.

Retaining systems of the type mentioned above are disclosed in each case in DE-A-32 06 695, DE-C-26 591 and GB-A-248 591. In each of these systems, use is made of a retaining bar which extends over the entire length of the sheet side edge and the carrier rail and can be connected to the carrier rail. The retaining bar engages, at its ends, in an eyelet connected to the carrier rail and/or a peg connected to the carrier rail projects into a sleeve or eyelet fitted at the retaining-bar end.

The object of the present invention is to provide a retaining system of the type mentioned in the introduction which is an alternative to said known retaining system.

The retaining system according to the invention, which achieves this object, is characterized in that the retaining bar extends continuously or in retaining-bar sections, spaced apart from one another in the longitudinal direction of the bar, only over part of the length of the sheet side edge, in that, for the purpose of filling that length of the retaining bar which is absent in relation to the carrier rail, at least one supplementary segment, which is parallel to the carrier rail, projects from the carrier rail, in the direction of the spine, into the cover, and in that the retaining bar and the supplementary segment are lined up in a row one beside the other in a hinge-like manner and pinned to one another.

Such a retaining bar completed by supplementary segments advantageously provides a bound sheet stack with a certain level of stability, in particular when use is made of a thin cover.

In a preferred embodiment of the invention, the edge surface of the at least one sheet, or of a stack formed from a plurality of sheets, is directed towards the retaining bar and preferably butts against the retaining bar. It goes without saying that in the case of a plurality of sheets, which may be adhesively bonded to one another in accordance with the known bookbinding method, this edge side forms the spine of the sheet stack. The usable surface area is advantageously not covered and restricted by the retaining and connecting device in this embodiment.

The thickness of the retaining bar here advantageously does not at least to any significant extent exceed the thickness of the at least one sheet, or sheet stack. In a space-saving manner, as seen in the plan view of the edge side or spine, the retaining bar then does not project laterally beyond the edge side or the spine. For the thickness of a cover with the sheet stack bound therein, it is thus advantageously only the thickness of the sheet stack, and not of the retaining and connecting device, which is critical.

In a further embodiment of the invention, a plurality of retaining bars are provided for respectively securing a single sheet, or a plurality of stack-forming sheets. The different sheet stacks may be assigned, for example, different contents such as calendars, address books, etc. The individual constituent parts of a volume may then advantageously be easily exchanged and can be handled separately from the volume.

If, corresponding to a further configuration of the invention, the retaining bar, which is connected to the carrier rail, is mounted rotatably about its longitudinal axis, for example on the carrier rail, it is possible for the entire sheet stack assigned to such a rotatable retaining bar to be pivoted, this possibility for pivoting making it easier, for example, with a plurality of sheet stacks bound into a file, binder or some other type of cover, to handle the individual sheet stacks within the cover separately from one another and to leaf through the same.

The retaining bar can expediently be released from the carrier rail by overcoming a spring force.

In a further preferred embodiment, the retaining bar has at least one recess, serving for connection to the carrier rail. In particular, a recess is provided at least on one end side, it being possible for a connecting element which can be used for connection to the sheets or the carrier rail, in particular a connecting clip, to engage in said recess. Such a connecting clip is expediently elastic, with the result that, in order to release the connection between the retaining bar and carrier rail, it can be freed from the engagement in the recess on the end sides of the retaining bar by bending.

The retaining bar and supplementary segment may be formed as a tube, with the result that it is possible to use, as the hinge pivot pin, a pin which may possibly be continuous over the entire sheet-edge length and can be drawn out in order to release the retaining bar from the carrier. The hinge connection may alternatively be formed by pegs which project from the end sides of a supplementary segment or retaining bar or retaining-bar section and engage in a corresponding opening on the opposite end side of a retaining-bar section or supplementary segment. One of these pegs may advantageously be moved counter to the force of a spring arranged in the retaining bar or supplementary segment, with the result that, by virtue of the peg being pressed into the retaining-bar section or the supplementary segment, the retaining bar can be released from the hinge connection to the supplementary segment.

While it is conceivable for the sheets to be connected to the retaining bar in a non-releasable manner, for example, by adhesive bonding, possibly via adhesive strips, a preferred embodiment may provide a releasable connection between the at least one sheet and the retaining bar. For this purpose, it is possible to use clips which can be fitted, for example, onto the retaining bar in the direction transverse to the longitudinal axis thereof and of which the legs project laterally beyond the retaining bar and grip the sheets and hold them together. In an embodiment in which in each case two sheets are formed by a large folded sheet, it is possible to use, for the purpose of fastening the sheets on the retaining bar, a clamping wire strap which extends along the retaining bar and the abovementioned folding line and engages, by way of angled ends, in engagement openings which are provided on the end sides of the retaining bar.

Figure 2:
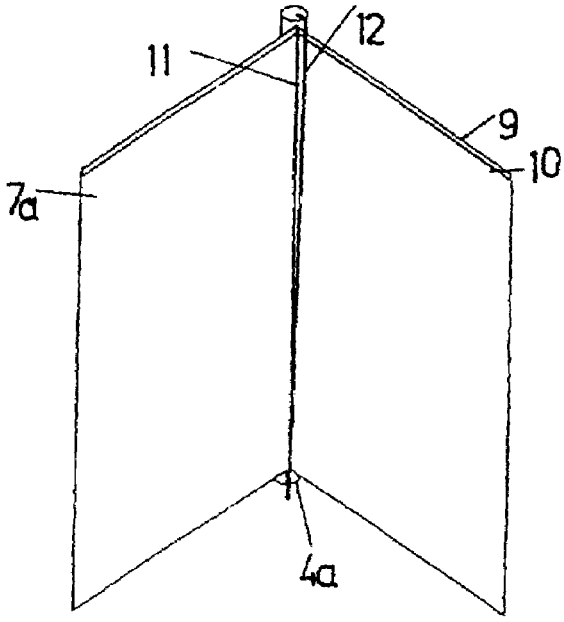
Figure 10:
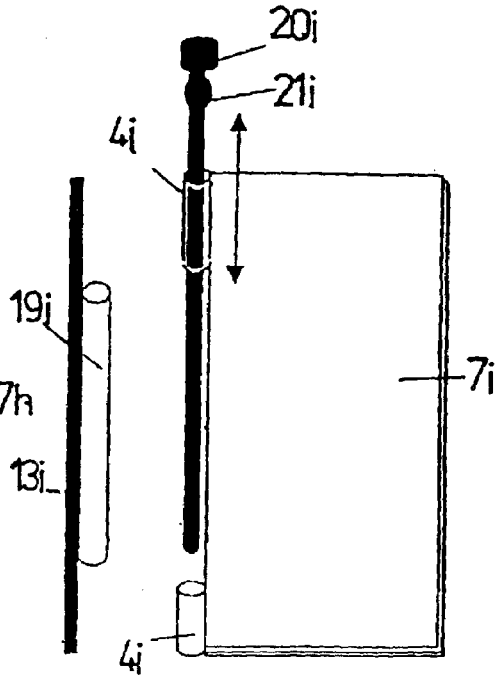
Figure 11:
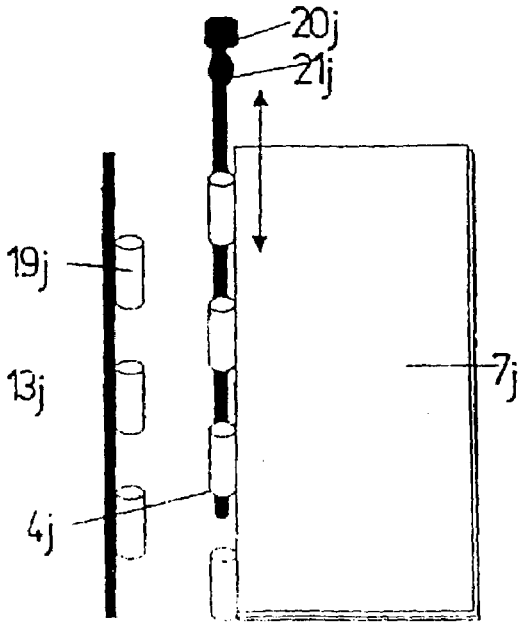
Figure 12:
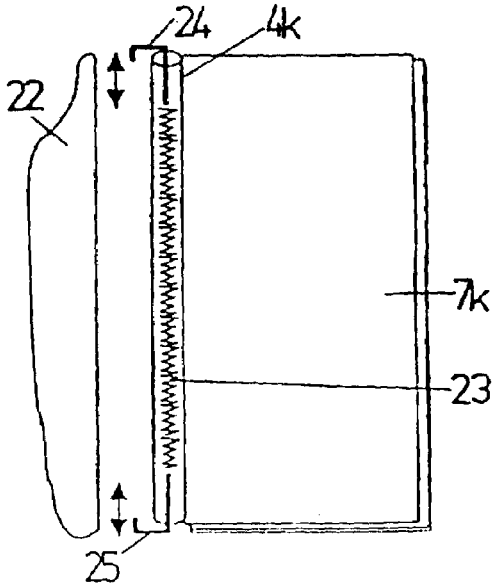
Figure 13:
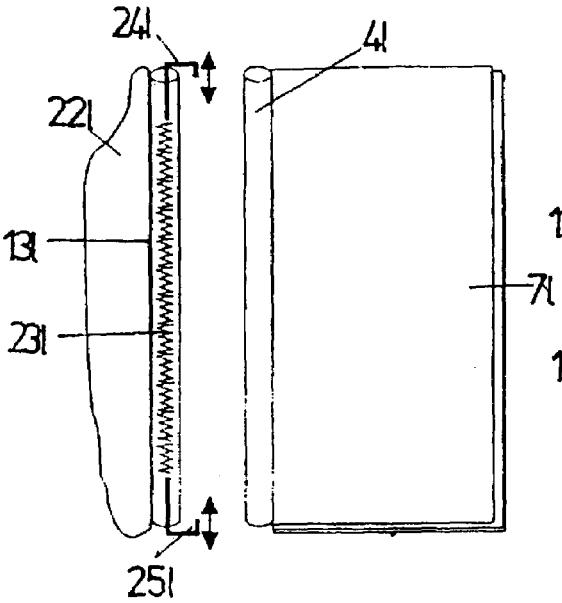
Figure 14:
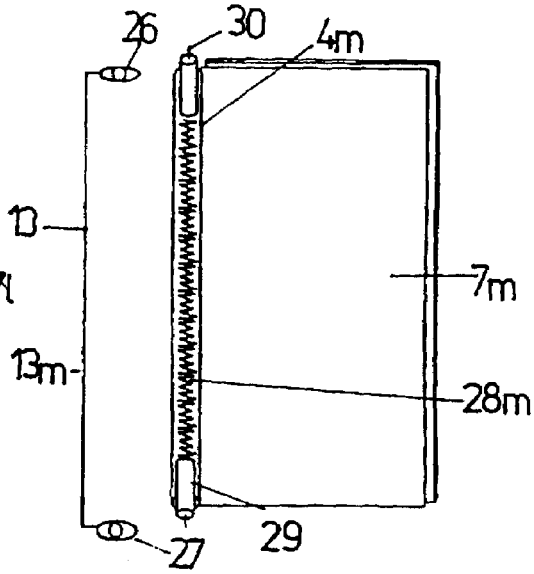
Figure 15:
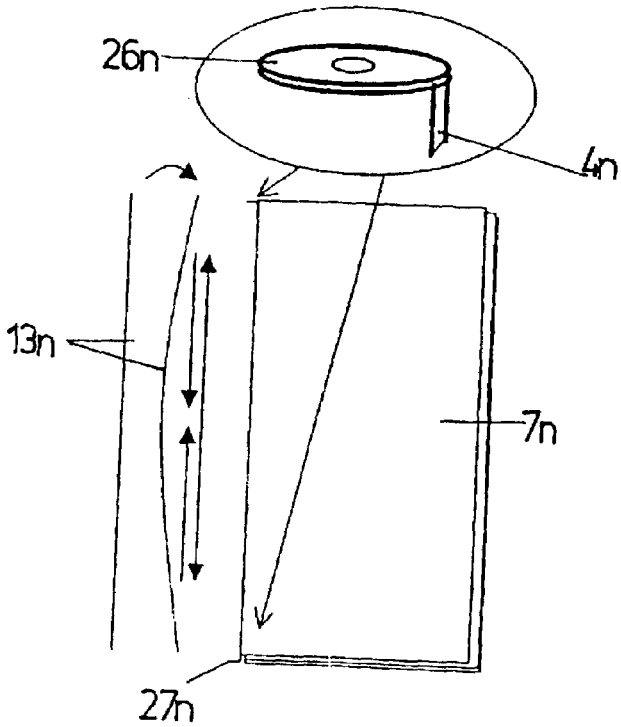

The invention will now be explained in more detail with reference to exemplary embodiments and the attached drawings, which relate to these exemplary embodiments and in which:

FIG. 1 shows an exemplary embodiment for a retaining system, having a retaining bar, which is intended for paper sheets at the ends of which there are formed engagement openings for connecting elements for connecting the retaining bar to a carrier, FIG. 2 shows a second exemplary embodiment for a retaining system, in the case of which in each case two sheets are formed by a large folded sheet, the sheets being secured on a retaining bar by a wire strap engaging in the fold, FIGS. 3 to 11 show different exemplary embodiments of a sheet-retaining system according to the invention, in the case of which a retaining bar can be connected to supplementary segments, which are fitted on a carrier rail, in a hinge-like manner, FIGS. 12 to 14 show further exemplary embodiments for sheet-retaining systems, which are similar to the systems from FIGS. 1 and 2, and FIG. 15 shows a sheet-retaining system with an elastic carrier rail.

FIG. 1 shows paper sheets 1, 2 and 3 which can be connected to form a sheet stack 7. 4 indicates a retaining bar which, in the exemplary embodiment shown, is of tubular form, and has retaining clips 5 and 6 engaging in its tube openings, said retaining clips connecting the retaining bar 4 to a carrier (not shown) e.g. to the spine of a cover. The sheets 1, 2, 3 may be adhesively bonded in accordance with the known bookbinding method to form the sheet stack 7. The retaining bar 4 extends along the sheet edges which are directed towards it, said retaining bar being located opposite the spine of the bound sheet stack or block and butting against the same.

The sheet stack may be connected to the retaining bar 4 by means of adhesive tape. For connection to the sheet stack, however, it is also possible to use clips which are indicated at 8, can be fitted onto the retaining bar 4 in the direction transverse to the longitudinal axis thereof and of which the legs grip the edge of the sheet stack. If the clips have a sufficiently large clamping force, prior binding of the sheets may possibly be dispensed with. It goes without saying that it would be possible for the entire retaining bar to have such a clip profile throughout its cross section.

Finally, it would also be possible for the retaining bar to be adhesively bonded to the sheets over the entire length of the stack spine. For this purpose, the retaining-bar surface which is directed towards the stack spine could be suitably shaped and could possibly be planar.

It is possible for a plurality of retaining bars 4, which are each connected to a sheet stack, to be accommodated, for example, within a cover, for example one sheet stack containing an address book and another sheet stack containing a calendar.

At least one of the retaining clips 5 and 6 is expediently elastic, with the result that it can be released from engagement in the retaining bar 4 by bending. It is then advantageously possible for optionally the calendar or the address book to be removed individually from the cover.

The sheet stack removed from the cover is advantageously stabilized by the retaining bar 4. It can barely be flexed in the direction transverse to the retaining bar.

In particular if the thickness of the retaining bar 4 does not exceed the thickness of the sheet stack, the retaining bar 4 requires only a small amount of installation space. Above all, the thickness of a sheet-stack-containing cover is then determined possibly just by the thickness of the sheet stacks. At clip locations, the retaining bar 4 could be provided with corresponding annular recesses, with the result that, apart from projecting in the direction of the sheets, the clips do not project radially beyond the retaining bar.

In the following figures, parts which are the same or have the same effect, are given the same designation and this, corresponding to the order of the figures, has the letters a, b, c, etc. appended to it in alphabetical order.

In FIG. 2, a sheet stack 7*a* is formed by large folded sheets 9 and 10 with folds 11. A tubular retaining bar 4*a* extends over the entire length of the folds 11. The sheet stack 7*a* is retained on the retaining bar 4*a* by a wire strap which engages against a [sic] in the fold of the outermost large sheet and has angled ends engaging in the tube openings of the retaining bar 4*a*. Furthermore, it would also be possible for connecting elements which correspond to the above-described retaining clips 5 and 6 and are intended for connection to a sheet carrier, in particular a cover, to engage in the tube opening.

Figure 3:
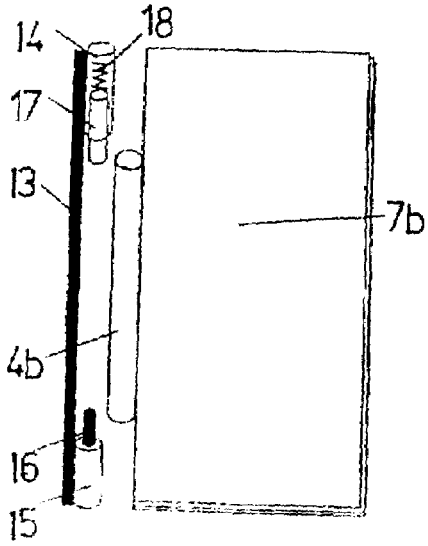

In the exemplary embodiment from FIG. 3, a retaining bar 4*b* extends only over part of the length of the sheet edges, or of the sheet stack spine, directed towards it. Projecting from the carrier rail 13 are supplementary segments 14 and 15, which can be arranged coaxially with the tubular retaining bar 4*b*. In the relevant exemplary embodiment the supplementary segments correspond to the retaining bar 4 in terms of cross section.

Extending axially from the supplementary segment 15 is a peg 16 for engagement in that tube opening of the retaining bar 4 which is directed towards it. The peg 16 is connected rigidly to the supplementary segment 15. A peg 17, which projects axially from the supplementary segment 14 and is provided for engagement in the opposite tube opening, can be moved in a guide in the supplementary segment 14 counter to the force of a spring 18 arranged therein. The retaining bar and the supplementary segments with the pegs produce a hinge connection between the block 7*b* and the carrier rail 13.

The distance between the supplementary segments 14 and 15 is greater than the length of the retaining bar 4*b*, with a displacement clearance being left. The peg 17 butts against a stop (not shown) in the retaining bar 4*b*. Upon displacement in the axial direction, with the spring 18 being compressed in the process, the peg 16 can be freed from engagement in the retaining bar and the retaining bar, with the sheet stack 7*b* fastened thereon, can be released from its securing means. For release purposes, it is necessary for the retaining bar 4*b* to be moved upwards. This means, advantageously, that the weight of the stack 7*b* cannot cause the retaining bar to be separated accidentally from the carrier.

Figure 4:
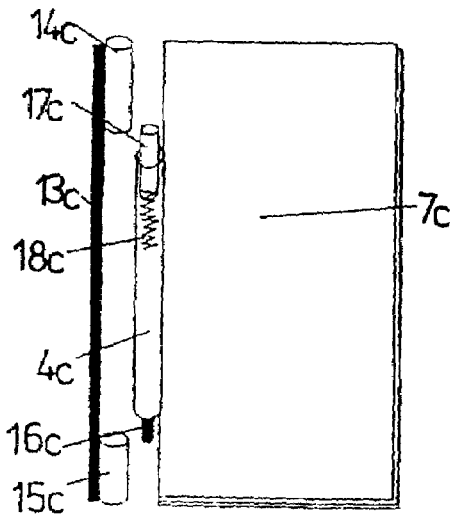

The exemplary embodiment from FIG. 4 differs from the exemplary embodiment from FIG. 3 in that the pegs 16*c* and 17*c*, rather than being fitted on supplementary segments 14*c* and 15*c*, are fitted, together with a spring 18*c*, on a retaining bar 4*c*, and the supplementary segments have corresponding engagement openings for the pegs.

Figure 5:
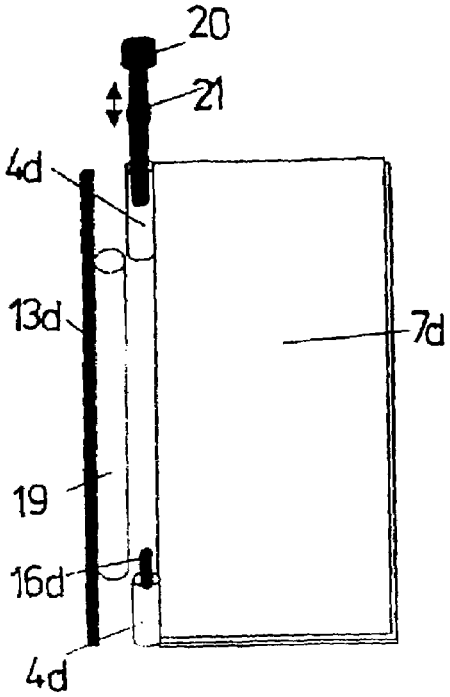

In the exemplary embodiment from FIG. 5, a retaining bar 4*d* is discontinuous, and it is possible for the interspace produced by the discontinuity to be filled in a coaxial arrangement with the retaining bar 4*d* by a supplementary segment 19 connected to a carrier rail 13*d*.

With the production of a hinge connection, a peg 16*d* engages in a corresponding opening on the end side of the supplementary segment 19, which may be formed, for example, as a tube. A peg 20 engages in such an opening on the opposite end side, and is guided through a tubular section of the retaining bar 4*d*. The peg 20, which is provided with a head, has a thickening 21 by means of which the fitted-in peg is clamped and secured against dropping out. In order to remove the peg for the purpose of removing the retaining bar from its securing means, however, the clamping can easily be released.

Figure 6:
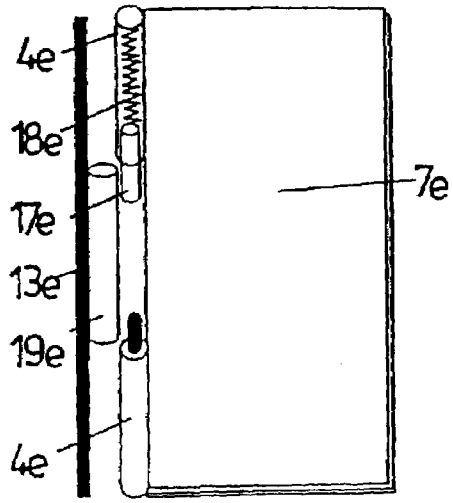

In the exemplary embodiment from FIG. 6, use is made, instead of a peg 20 which is guided through a section of the retaining bar, of a peg 4*e* [sic] which can be displaced in a retaining bar 4*e* counter to a spring 18*e* and comes into abutment against a stop (not shown) within a supplementary segment 19*e*. Release of the retaining bar 4*e* from its securing means can also be achieved here, in the manner described with reference to FIG. 3, by displacement of the divided retaining bar 4*c* [sic], with the spring 18*c* [sic] being compressed in the process.

Figure 7:
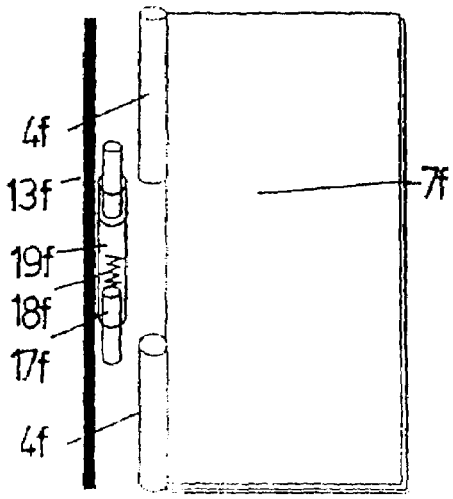

In the exemplary embodiment from FIG. 7, a peg 17*f* which can be moved counter to the force of a spring 18*f* is fitted on a supplementary segment 19*f* in addition to a peg which is connected rigidly to the supplementary segment 19*f*. As in the case of the previous exemplary embodiments, for the purpose of releasing a discontinuous retaining bar 4*f* from its securing means, the spring 18*f* is compressed via the peg 17*f*, which butts against a stop in the retaining bar 4*f*, until the peg which is located opposite the peg 17*f* is freed from its engagement in the retaining bar 4*f*.

Figure 8:
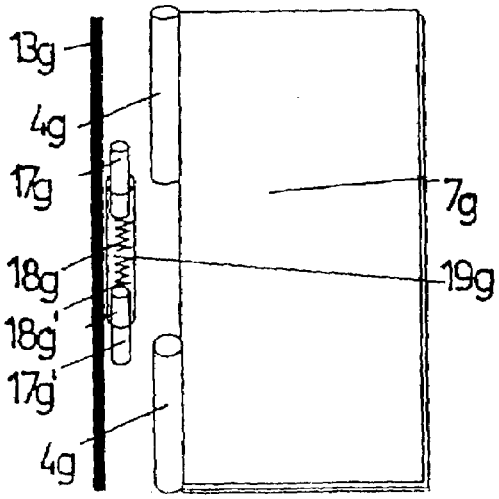

In the exemplary embodiment from FIG. 8, two movable pegs 17*g* and 17*g*' are fitted on a supplementary segment 19*g*, and each of these pegs butts against a stop (not shown) in the discontinuous retaining bar 4*g* and can be displaced counter to the force of a spring 18*g*, 18*g*' respectively. For the purpose of releasing a retaining bar 4*g* from its securing means, it is possible, in this exemplary embodiment, for the retaining bar 4*g* to be displaced optionally in opposite directions.

Figure 9:
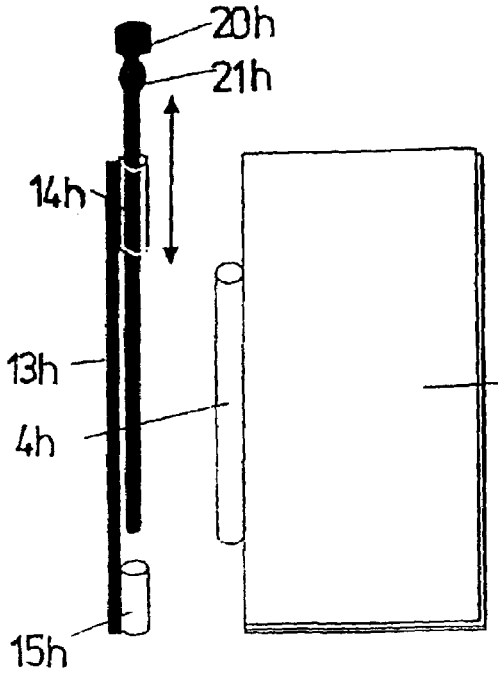

In the exemplary embodiment from FIG. 9, a retaining bar 4*h* and supplementary segments 14*h* and 15*h* are formed continuously as a tube, with the result that a peg 20*h* extending over the entire sheet length can be used in order to produce a hinge connection.

In the exemplary embodiment from FIG. 10, two retaining sections 4*i* and a supplementary segment 19*i* likewise form a continuous tube, and use is made of a peg 20*i* which is the same as the peg 20*h*.

In the exemplary embodiment from FIG. 11, a retaining bar 4*j* is subdivided into a plurality of spaced-apart sections. Supplementary segments 19*j* are provided to correspond to the interspaces present. The retaining-bar sections as well as the supplementary segments are of tubular form, with the result that a continuous peg 20*j* can be fitted through the mutually aligned bar sections and supplementary segments, a hinge connection being formed in the process.

In the exemplary embodiment from FIG. 12, a tension spring 23 is arranged in a tubular retaining bar 4*k*, the ends of said tension spring being connected to a hook element 24, 25. The hook elements 24 and 25 can act on a possible hook-in means, e.g. an eyelet, formed on a sheet carrier 22, e.g. a cover.

In the exemplary embodiment from FIG. 13, a sheet carrier 22*l* has a tubular carrier rail in which a tension spring 23*l*, corresponding to the tension spring 23, is arranged by way of hook elements 24*l* and 25*l*. The hook elements 24*l* and 25*l* can be fitted into the tube openings of a correspondingly formed retaining bar 4*l*. It goes without saying that, rather than having to be formed continuously as a tube, the retaining bar 4*l* merely requires suitable recesses at its ends, into which the hook elements 24*l* and 25*l* can be fitted.

In the exemplary embodiment from FIG. 14, a carrier rail 13*m*, preferably in the form of a sheet-metal part, has angled portions 26 and 27 each with an eyelet. A compression spring 28 is arranged in a tubular retaining bar 4*m*. The compression spring 28 has, at both ends, an end segment which is guided in the retaining bar 4*m* and has a peg 30 which engages in the eyelet of the respective angled portion 26, 27.

The exemplary embodiment from FIG. 15 provides a sheet-metal retaining bar 4*n* with eyelet-containing angled ends 26*n* and 27*n*. An elastic carrier rail 13*n* engages in the eyelets. The carrier rail 13*n* can be released from engagement in the eyelets by elastic bending.

In the exemplary embodiments in which a carrier rail 13 is used, said carrier rail is sewn, adhesively bonded or fastened by stapling elements or in some other way to the rest of the carrier, e.g. a cover.

In summary, the following advantages of the novel retaining system may be cited: it allows files and the like to be of compact form, by known annular retaining elements on files being dispensed with. This compact form is beneficial to the appearance. The solution allows flexibility and a wide range of variants. Calendar units may be exchangeable, monthly, quarterly, or half-yearly. Possible supplements may be provided by a wide range of supplementary sheets which are printed in different ways (blank, square ruled, ruled, info blocks, etc.). The space-saving form ultimately increases the utilization of the paper. Products with the sheet-securing means according to the invention have a stable appearance because the paper blocks are secured in a play-free manner in the volumes. It is possible, for example, for 2, 3, 4 or even more retaining bars, each for one block, to be accommodated in a volume.

What is claimed is:

1. In a retaining system for securing sheets (7*b*–7*j*) in a cover having a spine, each sheet having a sheet side edge having a length, the system comprising a carrier rail (13, 13*c*–13*j*), which is arranged on the spine of the cover and extends continuously over a length of the sheet side edge directed towards the spine, and having a retaining and connecting device which is provided for securing at least one sheet at the sheet side edge and has a retaining bar (4*b*–4*j*) which extends along the sheet side edge and the carrier rail via which the sheet can be connected indirectly to the carrier rail, the improvement comprising that the retaining bar (4*b*–4*j*) extends continuously (4*b*, 4*c*, 4*h*) or in retaining-bar sections (4*c*, 4*e*–4*g*, 4*i*, 4*j*), spaced apart from one another in a longitudinal direction of the bar, only over part of the length of the sheet side edge (13, 13*c*–13*j*), wherein, for the purpose of filling that length of the retaining bar (4*b*–4*j*) which is absent in relation to the sheet side$_{13}$ edge, at least one supplementary segment (14, 14*c*, 14*h*; 15, 15*c*, 15*h*: 19, 19*c*–19*g*, 19*i*, 19*j*), which is parallel to the carrier rail, projects from the carrier rail, in a direction of the spine, into the cover, and wherein the retaining bar and the supplementary segment are lined up in a row one beside the other in a hinge-like manner and pinned to one another, wherein the retaining bar (4*b*, 4*c*, 4*e*, 4*f*, 4*g*) can be released from the carrier rail by overcoming a spring force.

2. Sheet-retaining system according to claim 1, wherein the edge surface of the at least one sheet, or of a sheet stack (7*b*–7*j*) formed from a plurality of sheets, is directed towards the retaining bar (4*b*–4*j*) and preferably butts against the retaining bar.

3. Sheet-retaining system according to claim 1, wherein the thickness of the retaining bar (4*b*–4*j*) is less than or approximately equal to the thickness of the at least one sheet, or of a stack (7*b*–7*j*) of a plurality of sheets.

4. Sheet-retaining system according claim 1, wherein a plurality of retaining bars for respectively securing least one sheet, or a stack of a plurality of sheets, can be fitted in the cover.

5. Sheet-retaining system according to claim 1, wherein the retaining bar (4*b*–4*j*), which is connected to the carrier rail (13, 13*b*–13*j*), is mounted about its longitudinal axis.

6. Sheet-retaining system according to claim 1, wherein the retaining bar (4*b*–4*j*) has at least one recess, serving for connection to the carrier rail, and a recess for the engagement of a connecting element (17; 20) is provided preferably on at least one end side.

7. Sheet-retaining system according to claim 1, wherein the at least one sheet is connected releasably to the retaining bar.

* * * * *